US007971578B2

(12) United States Patent
Lim et al.

(10) Patent No.: US 7,971,578 B2
(45) Date of Patent: Jul. 5, 2011

(54) EXHAUST GAS RECIRCULATION VALVE FOR VEHICLE

(75) Inventors: Chang Sik Lim, Icheon-si (KR); Ki Ho Jung, Cheongwon (KR); Seok Ryul Park, Cheongwon (KR); Yong Soo Jang, Daegu (KR)

(73) Assignee: Kamtec Inc., Iwol-Myeon (KR)

( * ) Notice: Subject to any disclaimer, the term of this patent is extended or adjusted under 35 U.S.C. 154(b) by 226 days.

(21) Appl. No.: 12/365,086

(22) Filed: Feb. 3, 2009

(65) Prior Publication Data

US 2010/0031938 A1 Feb. 11, 2010

(30) Foreign Application Priority Data

Feb. 4, 2008 (KR) ..... 10-2008-0011342
Feb. 2, 2009 (KR) ..... 10-2009-0007845
Feb. 2, 2009 (KR) ..... 10-2009-0007846

(51) Int. Cl.
*F02B 47/08* (2006.01)
*F02B 47/00* (2006.01)

(52) U.S. Cl. ..... 123/568.17; 701/108

(58) Field of Classification Search ..... 123/568.17, 123/568.19, 568.21, 568.12, 559.1, 316; 60/605.1, 605.2; 701/108
See application file for complete search history.

(56) References Cited

U.S. PATENT DOCUMENTS 4,020,809 A * 5/1977 Kern et al. ..... 123/568.24
4,924,840 A * 5/1990 Wade ..... 123/568.19
7,140,392 B2 * 11/2006 Blomquist et al. ..... 137/637.3
7,461,642 B2 * 12/2008 Bircann et al. ..... 123/568.23
2005/0109024 A1 * 5/2005 Nohl et al. ..... 60/324
2008/0029073 A1 * 2/2008 Klipfel et al. ..... 123/568.11

* cited by examiner

*Primary Examiner* — Mahmoud Gimie
(74) *Attorney, Agent, or Firm* — Maschoff Gilmore & Israelsen

(57) ABSTRACT

The present invention relates to an exhaust gas recirculation (EGR) valve for a vehicle. The EGR valve includes a valve housing connected to an exhaust line for discharging exhaust gas therethrough, having a flow line with an inside area divided for taking and re-circulating a portion of the exhaust gas to a suction manifold, a driving unit on one side of the valve housing, and a valve unit mounted in a flow line of the valve housing for receiving driving force from the driving unit directly to control flows of the exhaust gas flowing through the flow line at the same time individually, thereby making stable control of the exhaust gas flowing through the EGR valve, preventing damage caused by the high temperature exhaust gas, and preventing the exhaust gas from leaking to an outside of the EGR valve.

16 Claims, 21 Drawing Sheets

620

EXHAUST GAS RECIRCULATION VALVE FOR VEHICLE

CROSS REFERENCE TO RELATED APPLICATION

This application claims the benefit of the Patent Korean Application Nos. 10-2008-0011342, filed on Feb. 4, 2008, 10-2009-0007845, filed on Feb. 2, 2009 and 10-2009-0007846, filed on Feb. 2, 2009 which are hereby incorporated by reference as if fully set forth herein.

BACKGROUND OF THE DISCLOSURE

1. Field of the Disclosure

The present invention relates to an exhaust gas recirculation (EGR) valve for a vehicle.

2. Discussion of the Related Art

In general, in order to suppress generation of nitrogen oxide from exhaust gas of an engine mounted to a vehicle, a method used presently mostly is use of the EGR valve for adding a portion of cooled exhaust gas to fuel-air mixture and introducing to a cylinder.

Because a related art EGR valve is provided with an exhaust gas valve and EGR operation valve individually, not an unnecessary layout is required, but also operation thereof is unstable due to operation of the valve by different driving sources. Moreover, since the high temperature exhaust gas flows through the EGR valve, causing degradation of the EGR valve by the high temperature exhaust gas, a countermeasure is required, urgently.

SUMMARY OF THE DISCLOSURE

Accordingly, the present invention is directed to an exhaust gas recirculation (EGR) valve for a vehicle.

An object of the present invention is to provide an EGR valve of three-way type for a vehicle, in which single driving source is used for making linear control of the EGR valve with the same shaft.

Another object of the present invention is to provide an EGR valve for a vehicle, which is cooled by air for preventing the EGR valve from degrading by high temperature exhaust gas.

Another object of the present invention is to provide an EGR valve for a vehicle, which enables stable re-circulation of exhaust gas to a suction manifold of the vehicle.

Another object of the present invention is to provide an EGR valve for a vehicle, which can minimize leakage of the exhaust gas to an outside of the EGR valve of the vehicle.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an EGR valve for a vehicle includes a valve housing connected to an exhaust line for discharging exhaust gas therethrough, having a flow line with an inside area divided for taking and re-circulating a portion of the exhaust gas to a suction manifold, a driving unit on one side of the valve housing, and a valve unit mounted in a flow line of the valve housing for receiving driving force from the driving unit directly to control flows of the exhaust gas flowing through the flow line at the same time, individually.

The flow line in the valve housing includes an exhaust gas flow line having an exhaust gas hole formed therein for flow in/out of the exhaust gas, and a recirculation flow line having an EGR hole for recirculation of the exhaust gas to the suction manifold.

The flow line in the valve housing further includes a bypass flow line for making the exhaust gas flow line and the recirculation flow line in communication.

The valve unit includes a rotation shaft coupled to the driving unit and passed through the flow line in the valve housing, an exhaust control valve mounted to the rotation shaft for controlling opening of an exhaust gas hole according to rotation of the rotation shaft, and a re-circulation control valve mounted to the rotation shaft for controlling opening of an EGR hole according to rotation of the rotation shaft.

The re-circulation control valve includes a supporting shaft connected to and extended outward from the rotation shaft, a valve seat placed on the supporting shaft for opening/closing the EGR hole according to rotation of the rotation shaft, a seat spring placed on the supporting shaft for applying elastic force to the valve seat in a length direction of the supporting shaft, and a seat spring holder on an inside of the seat spring for holding the seat spring in a state the seat spring is placed in the seating spring holder to prevent the seating spring from falling off the supporting shaft.

The opening of the exhaust control valve is linearly proportional to the opening of the recirculation control valve.

The EGR valve further includes a heat cutoff plate mounted between the valve housing and the driving unit for preventing the driving unit suffering from damage by the high temperature exhaust gas flowing through the flow line.

The rotation shaft includes a first rotation shaft coupled to a gear unit in the driving unit, a coupling coupled to the first rotation shaft for receiving rotation force through the first rotation shaft, and a second rotation shaft coupled to the other side of the coupling having the exhaust control valve and the re-circulation valve mounted thereto.

The coupling includes a coupling plate, first and second cross shafts projected outwardly to left and right directions from the coupling plate respectively, wherein the first and second cross shafts are engaged with first and second cross recesses in ends of the first and second rotation shafts respectively.

The first cross shaft includes a spacing projection on a center for preventing heat from transmitting to the first rotation shaft from the high temperature exhaust gas through the second rotation shaft and the coupling, wherein the spacing projection makes point to point contact with the center of the inside of the first cross recess in the first rotation shaft.

The valve portion has a sealing member mounted thereto for preventing leakage of the exhaust gas.

The sealing member includes a sealing holder coupled to the second rotation shaft on an outside circumference of the second rotation shaft in a direction of the second cross recess, wherein the sealing holder has an inserting hole recessed inward toward the second rotation shaft.

The sealing member further includes a compression ring positioned between the exhaust control valve coupled to the second rotation shaft and the sealing holder and inserted in the inserting hole in the sealing holder.

The compression ring is in linear contact to an inside of the sealing holder.

The EGR valve further includes an elastic member between the coupling and the sealing holder for biasing the sealing holder toward the compression ring.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
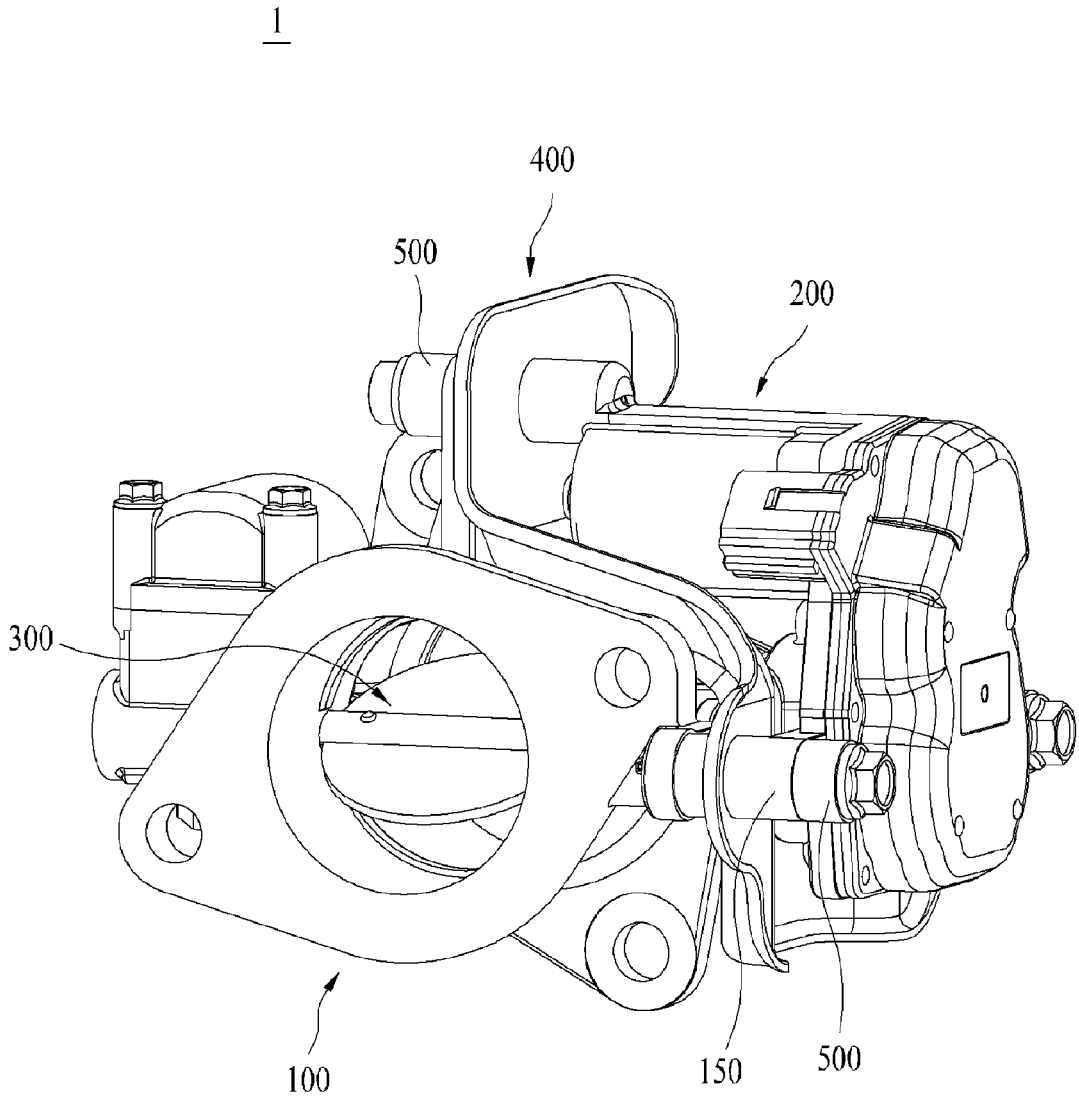
FIG. 1 illustrates a perspective view of an EGR valve for a vehicle in accordance with a preferred embodiment of the present invention.
Figure 2:
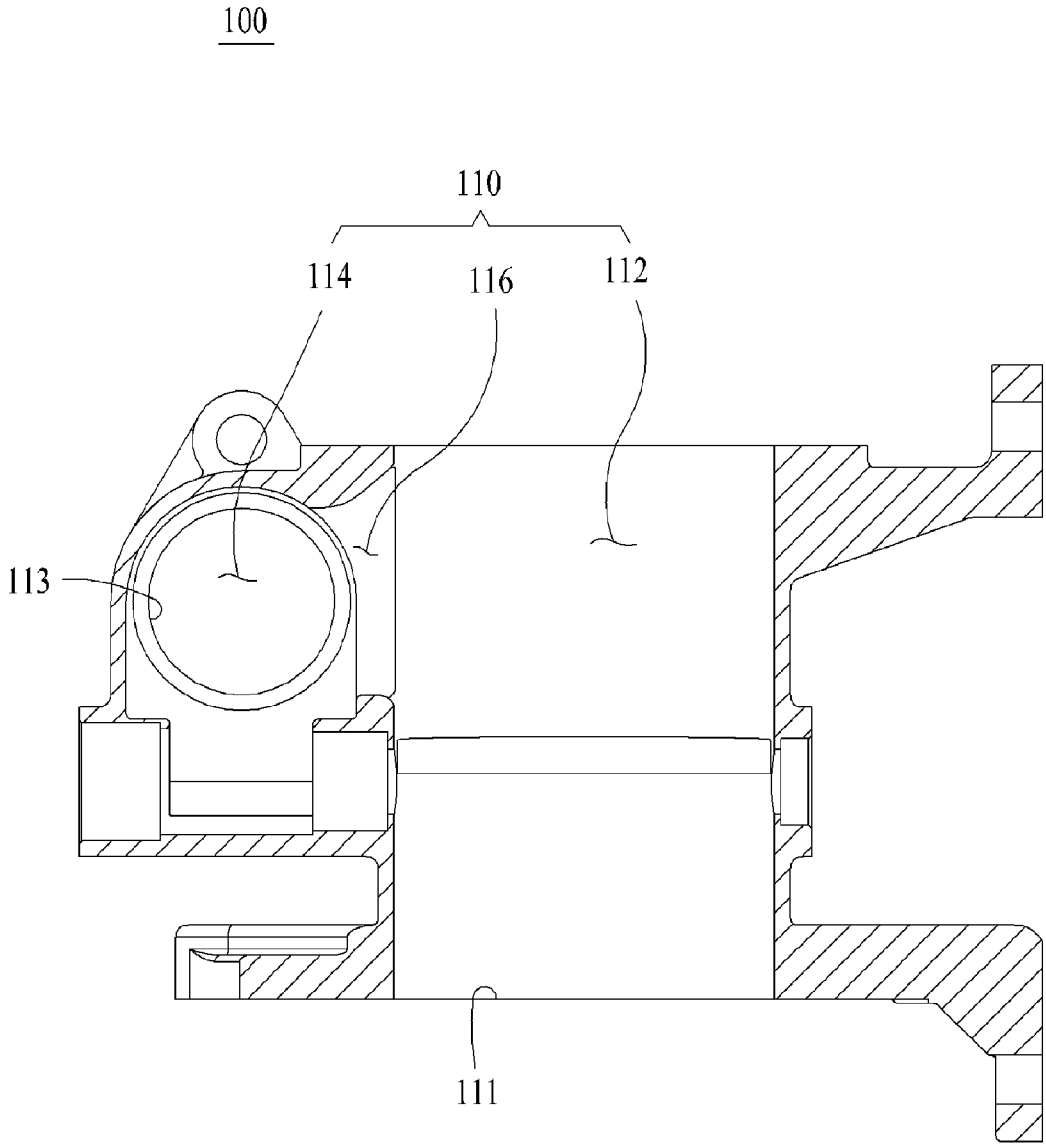
FIG. 2 illustrates a cross section of a valve housing in accordance with a preferred embodiment of the present invention.

Referring to FIGS. 1 and 2, the EGR valve 1 for a vehicle includes a valve housing 100 connected to an exhaust line 10 (See FIG. 15A) for discharging the exhaust gas therethrough, having a flow line 110 with an inside area divided for taking and re-circulating a portion of the exhaust gas to a suction manifold.

The EGR valve 1 is mounted to the exhaust line 10 between an engine (not shown) and an exhaust manifold (not shown) for re-circulation of the exhaust gas via a shortest distance at the time the exhaust gas re-circulates from the engine 1 to the engines 1.

The valve housing has a driving unit 200 on one side, and a valve unit 300 mounted in a flow line 110 of the valve housing 100 for receiving driving force from the driving unit 200 directly to control flows of the exhaust gas flowing through the flow line 110 at the same time, individually.

The driving unit 200 includes a motor built therein, a gear assembly of a plurality of gears coupled to a motor shaft of the motor, and a cover on driving unit having the driving unit 200 seated therein.

The EGR valve of the present invention is a low pressure application. Different from a high pressure EGR valve for receiving the exhaust gas from the engine, the lower pressure EGR valve receives the exhaust gas via an exhaust manifold, a turbo-charger, and a DPF (Diesel Particulate Filter Trap), and re-circulates the exhaust gas to the engine. The exhaust gas passed through the EGR valve flows along the exhaust line and discharged to an outside of the vehicle through a ternary catalysis.

Referring to FIG. 2, the flow line 110 in the valve housing 100 includes an exhaust gas flow line 112 having an exhaust gas hole 111 for flow in/out of the exhaust gas therethrough, and a re-circulation flow line 114 having an EGR hole 113 for re-circulating the exhaust gas to a suction manifold.

The exhaust gas flow line 112 has a diameter greater than the re-circulation flow line 114, relatively.

The flow line 110 in the valve housing 100 includes a bypass flow line 116 for making the exhaust gas flow line 112 and the re-circulation flow line 114 in communication. The bypass flow line 116 is a kind of cavity formed between the exhaust gas flow line 112 and the re-circulation flow line 114.

Figure 3:
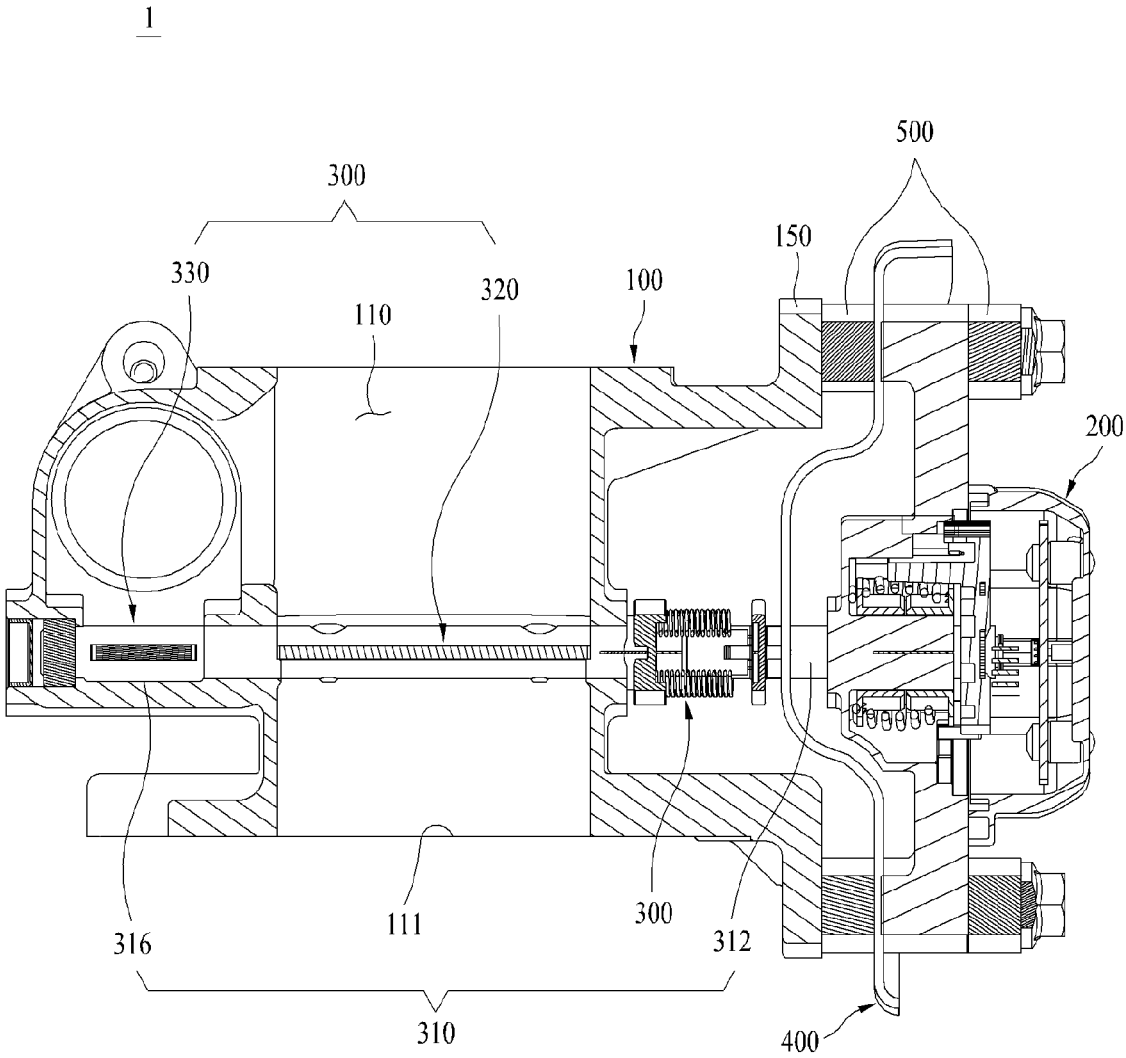
FIG. 3 illustrates a cross section of an EGR valve for a vehicle in accordance with a preferred embodiment of the present invention.
Figure 4:
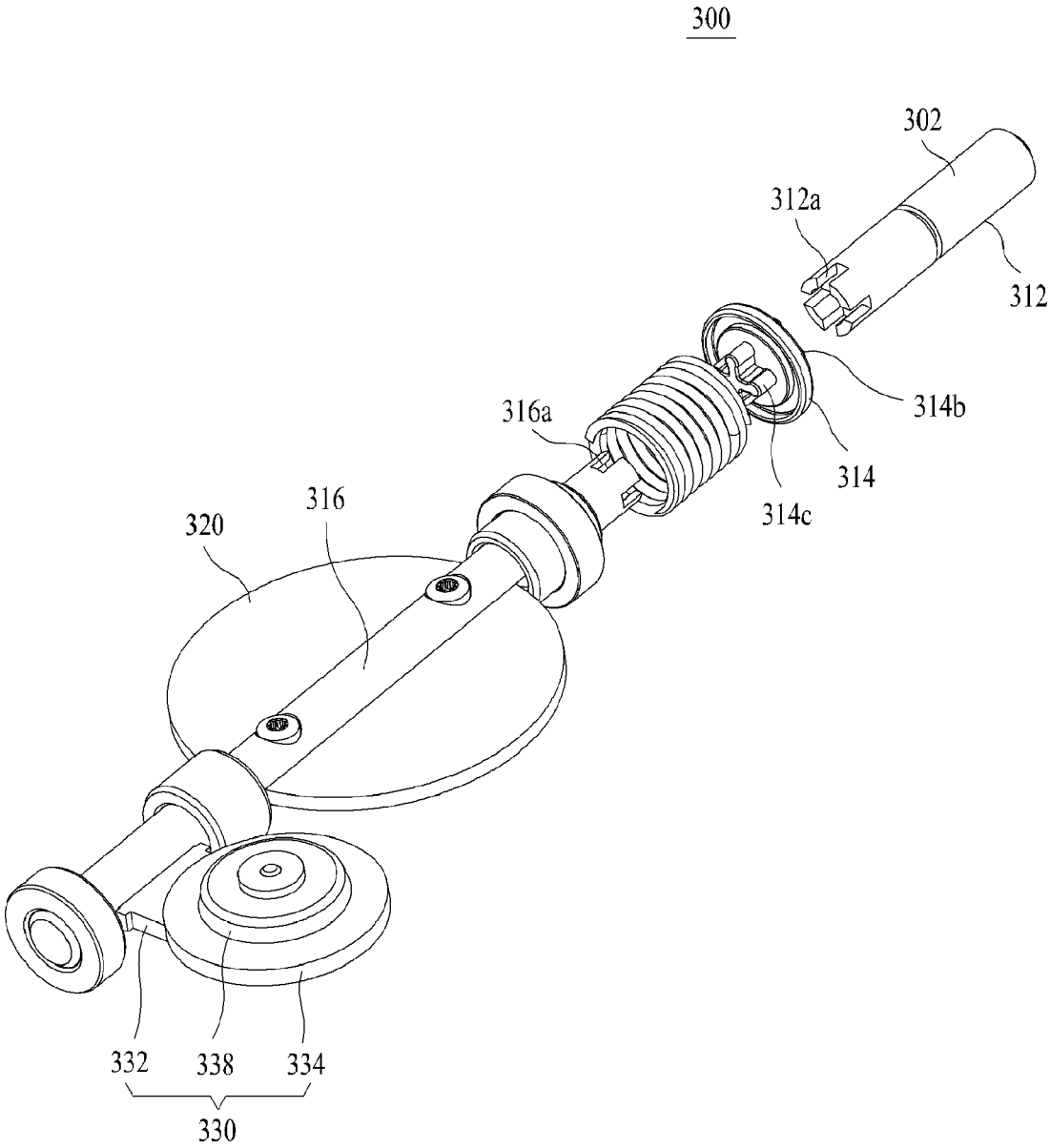
FIG. 4 illustrates a perspective view of a valve unit of an EGR valve for a vehicle in accordance with a preferred embodiment of the present invention.
Figure 5:
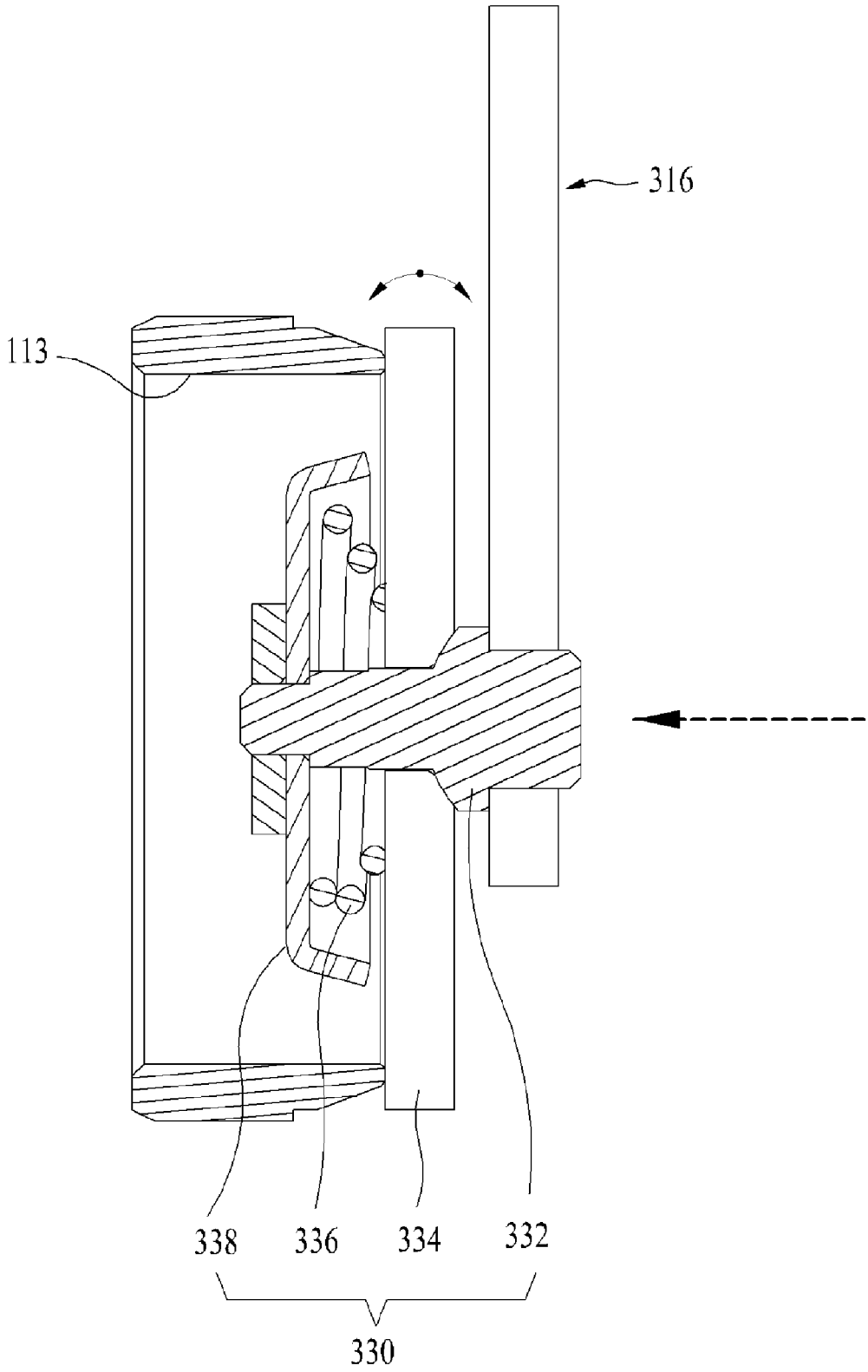
FIG. 5 illustrates a perspective view of a closed state of a re-circulation control valve in an EGR valve for a vehicle in accordance with a preferred embodiment of the present invention.

Referring to FIGS. 3 to 5, the valve unit 300 includes a rotation shaft 310 coupled to the driving unit 200 and passed through the flow line 110 of the valve housing 100, an exhaust control valve 320 mounted to the rotation shaft 310 for controlling opening of an exhaust gas hole 111 according to rotation of the rotation shaft 310, and a re-circulation control valve 330 mounted to the rotation shaft 310 for controlling opening of an EGR hole 113 according to rotation of the rotation shaft 310.

The exhaust control valve 320 is a circular plate having a middle portion placed in a slot in the rotation shaft 310 and fastened to the rotation shaft 310 with fastening means. The exhaust control valve 320 has fastening bushes placed in the rotation shaft 310 on opposite sides thereof the exhaust control valve 320 for preventing the exhaust control valve 320 from moving.

The re-circulation control valve 330 has a supporting shaft 332 connected to and projected outward from the rotation shaft 310.

The re-circulation control valve 330 also has a valve seat 334 placed on the supporting shaft 332 having a diameter relatively greater than a diameter of the EGR hole 113 for opening/closing the EGR hole 113 according to rotation of the rotation shaft 332.

The re-circulation control valve 330 also has a seat spring 336 placed on the supporting shaft 332 for applying elastic force to the valve seat 334 in a length direction of the supporting shaft 332, and a seat spring holder 338 on an inside of the seat spring 336 for holding the seat spring 336 in a state the seat spring is placed in the seating spring holder 338 to prevent the seating spring 336 from falling off the supporting shaft 332.

The valve seat 334 makes elastic deformation of the seat spring 336 owing to the exhaust gas such that the valve seat 334 is brought into close contact with an outside of the EGR hole 113 tightly.

Referring to FIG. 5, the seat spring 336 has a portion in contact with an inside bottom surface of the seat spring holder 338, of which diameter is similar to an inside diameter of the seat spring holder 338, and the diameter becomes the smaller as the seat spring 336 is extended from the portion toward the valve seat 334 in a form of a coil along the supporting shaft 332 the closer.

The seat spring 336 is mounted thus for making the valve seat 334 to operate with a minute gap around the supporting shaft 332 in a direction of arrow at the time the valve seat 334 is operated by a pressure of the exhaust gas.

The rotation shaft 310 has a coated layer 302 on a surface thereof for preventing strength thereof from impairing by the high temperature exhaust gas. The coated layer 302 is nitrided to form a nitride on a surface of steel to improve corrosion resistance, abrasion resistance, fatigue strength, and so on.

If the surface of the rotation shaft 310 is nitrided, compactness of the texture, hardness and kind of phase of the nitride formed thus, and an amount of carbon solid solution are changed, to influence to abrasion resistance, and corrosion resistance against the exhaust gas, thereby improving a lifetime.

The re-circulation control valve 330 is opened when the exhaust control valve 320 is closed, and vice versa. Above operation can be made as the exhaust gas hole is formed at 90° with respect to the EGR hole in the valve housing 100.

An opening of the exhaust control valve 320 and an opening of the re-circulation control valve 330 are linearly proportional because the exhaust control valve 320 and the re-circulation control valve 330 are connected to the driving unit 200 which is single drive source directly.

Mounted between the valve housing 100 and the driving unit 200, there is a heat cutoff plate 400 (See FIG. 1) for preventing the driving unit 200 suffering from damage by the high temperature exhaust gas flowing through the flow line 110. The heat cutoff plate 400 cuts off radiant heat to an outside of the valve housing 100 from the high temperature exhaust gas flowing through the valve housing 100. As a variation of the heat cutoff plate 400, the heat cutoff plate 400 may have a heat cutoff layer on an outside for cutting off the radiant heat.

Referring to FIG. 4, the rotation shaft 310 includes a first rotation shaft 312 coupled to a gear unit 210 in the driving unit 200, a coupling 314 coupled to the first rotation shaft 312 for receiving rotation force through the first rotation shaft 312, and a second rotation shaft 316 coupled to the other side of the coupling 314 having the exhaust control valve 320 and the re-circulation valve 330 mounted thereto. The coupling 314 serves as a medium for transmitting the rotation force to the second rotation shaft 316 from the first rotation shaft 312.

Figure 6A:
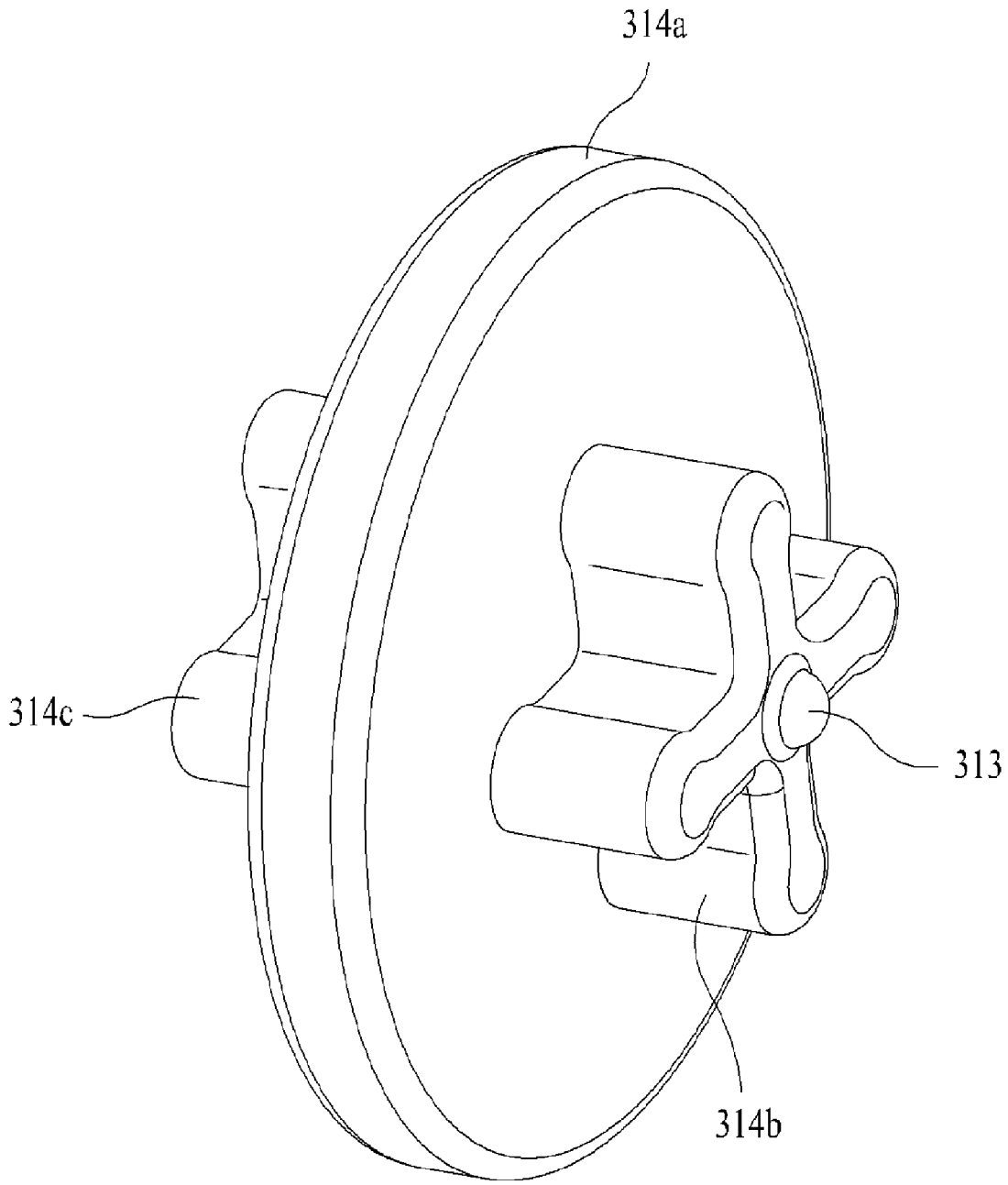
FIGS. 6A~6C illustrate perspective views of couplers in an EGR valve for a vehicle in accordance with a preferred embodiment of the present invention, respectively.
Figure 6B:
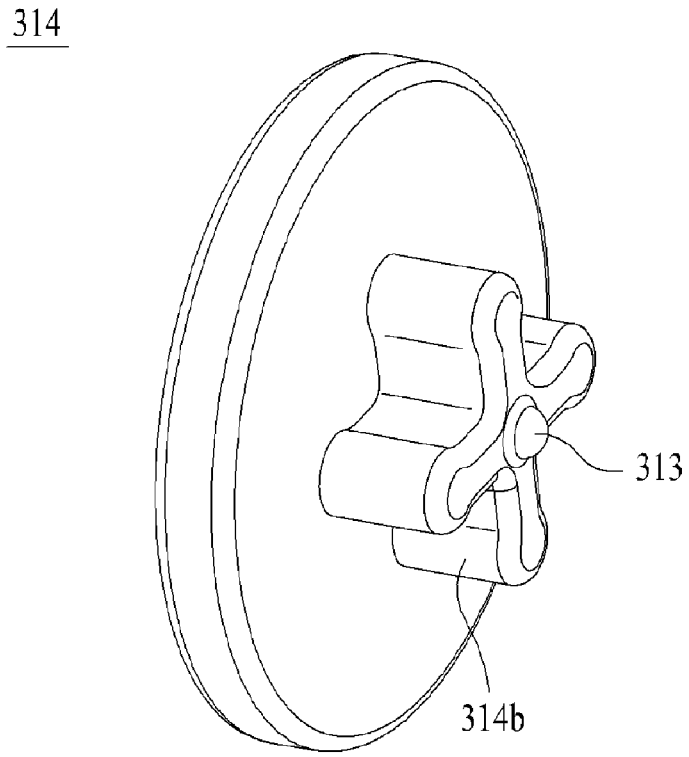
Figure 6C:
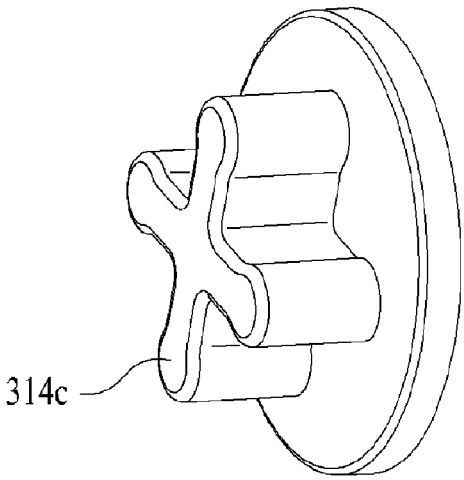

Referring to FIGS. 6A~6C, the coupling 314 includes a coupling plate 314*a* of a circular disk, first and second cross shafts 314*b* and 314*c* projected outwardly to left and right directions from the coupling plate 314*a* respectively, for engagement with first and second cross recesses 312*a* and 316*a* in ends of the first and second rotation shafts 312 and 316 respectively.

The coupling 314 and the first and second rotation shafts 312 and 316 are coupled together by means of the crosses for transmission of the rotation force from the driving unit 200 to the rotation shaft 310 without loss, perfectly.

The first cross shaft 314*b* has a spacing projection 313 on a center for preventing heat from transmitting to the first rotation shaft 312 from the high temperature exhaust gas through the second rotation shaft 316 and the coupling 314, by making point to point transmission of heat by means of the coupling 314 and the spacing projection 313 on the first rotation shaft 312, which minimizes the transmission of the heat of the high temperature exhaust gas.

Figure 7:
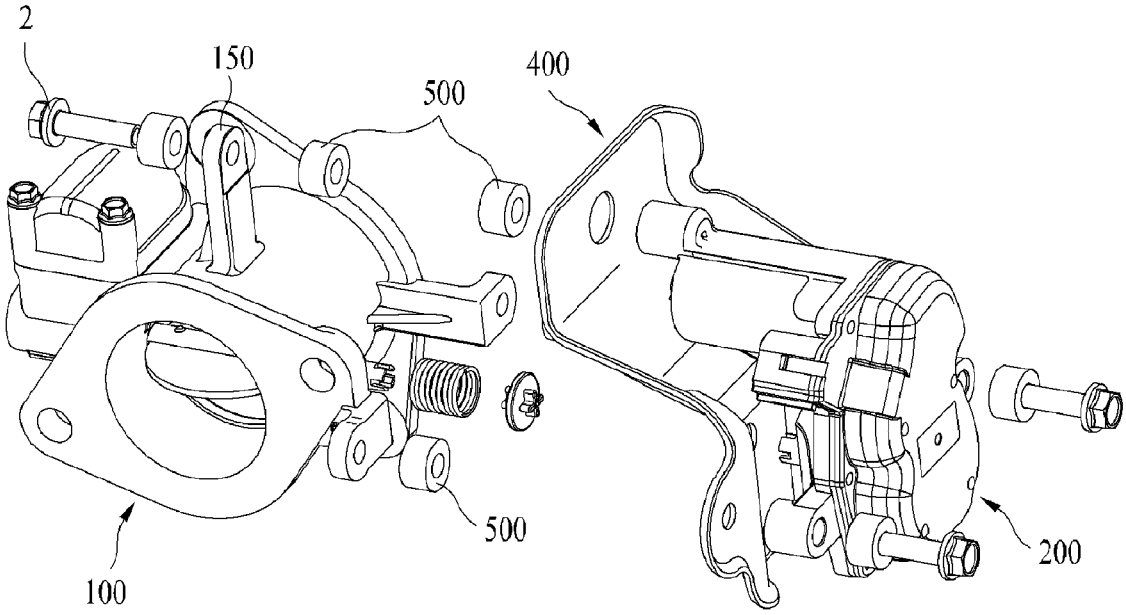
FIG. 7 illustrates an exploded perspective view of an EGR valve for a vehicle in accordance with a preferred embodiment of the present invention.
Figure 8:
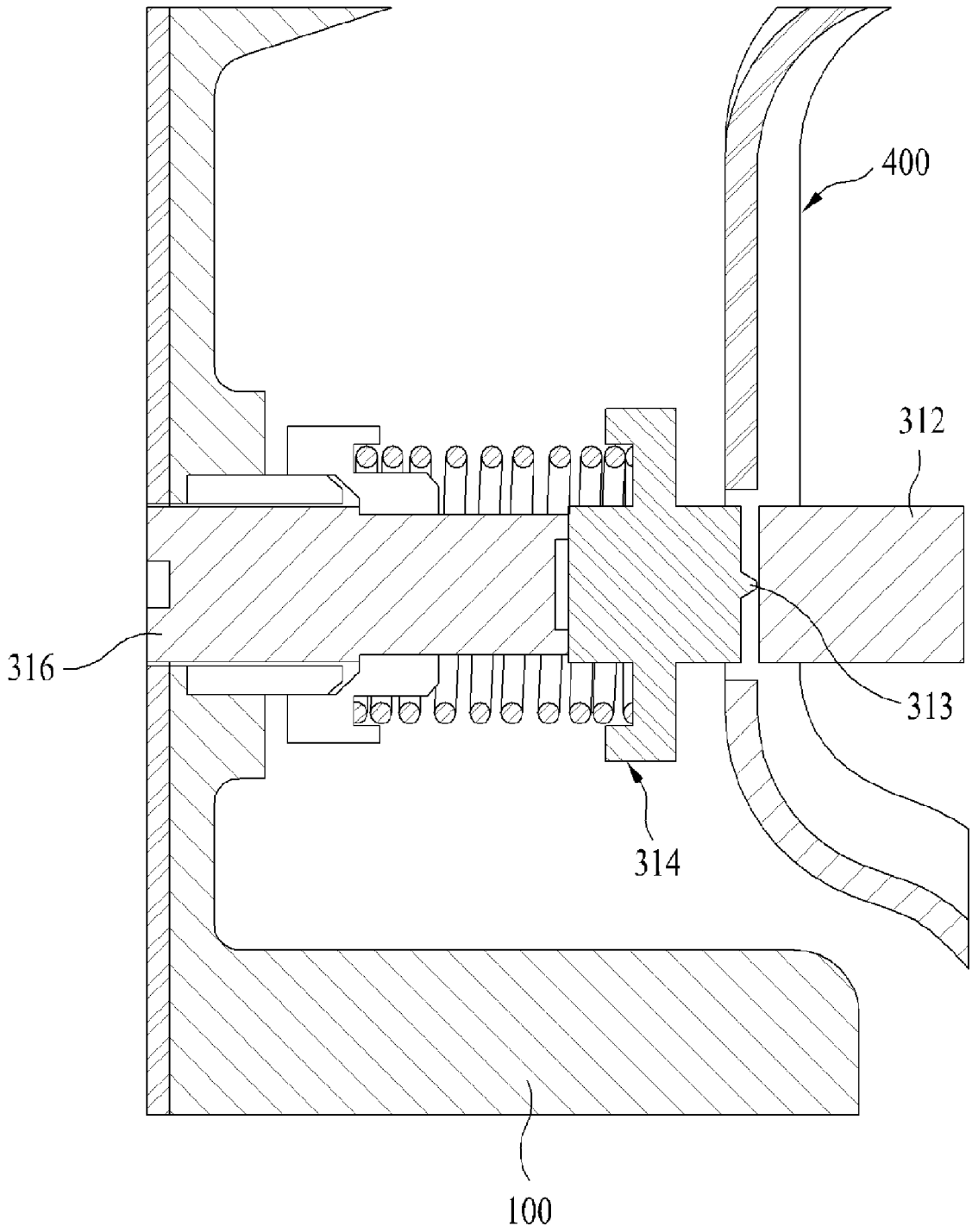
FIG. 8 illustrates a partial section of a rotation shaft connected to a coupling in an EGR valve for a vehicle in accordance with a preferred embodiment of the present invention.

Referring to FIG. 7, a mounting portion 150 for putting the valve housing 100 and the driving unit 200 together has a bush 500 mounted thereto for preventing heat from transmission to the driving unit 200 through the valve housing 100.

The mounting portion 150 has a mounting hole for fastening the valve housing 100 to the driving unit 200. There may be a plurality of mounting portions 150 on an outside of the valve housing 100.

The bush 500 is formed of ceramic. Because the ceramic has a low heat conductivity enough to cut off the heat transmission to the driving unit 200 from the valve housing 100, effectively.

There may be a plurality of the bushes 500. That is, the bushes may be mounted on opposite sides of the mounting portions 150.

Figure 9:
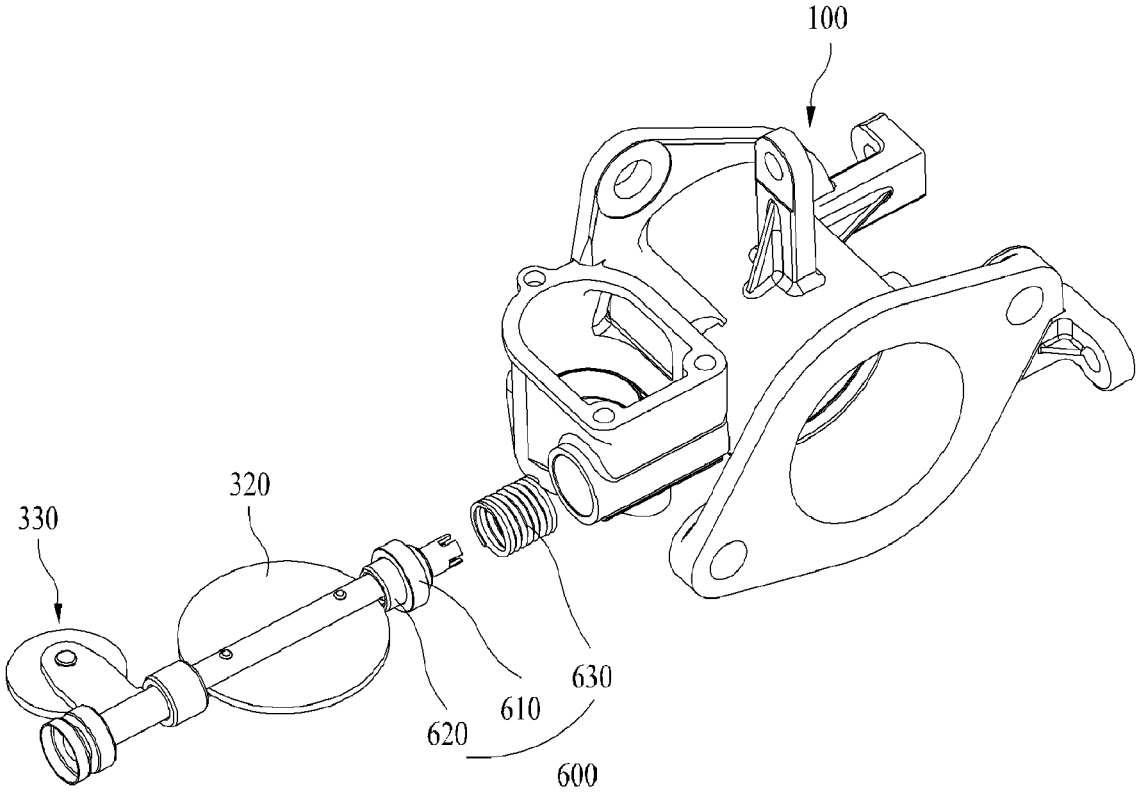
FIG. 9 illustrates a perspective view of a state in which a sealing member is coupled to a rotation shaft in an EGR valve for a vehicle in accordance with a preferred embodiment of the present invention.

Referring to FIG. 9, there is a sealing member 600 having a sealing holder 610 coupled to the second rotation shaft 316 on an outside circumference of the second rotation shaft 316 in a direction of the second cross recess 316*a*.

Figure 10A:
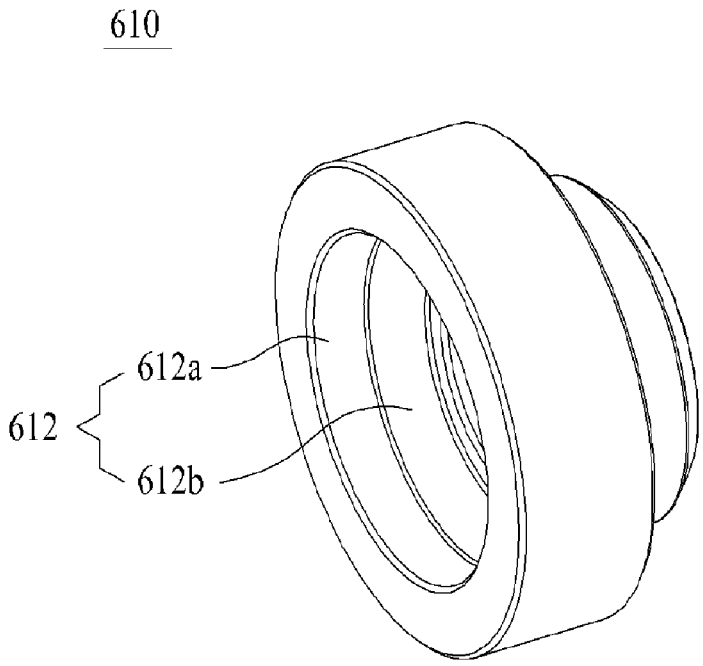
FIGS. 10A and 10B illustrate perspective views of sealing holders in an EGR valve for a vehicle in accordance with a preferred embodiment of the present invention, respectively.
Figure 10B:
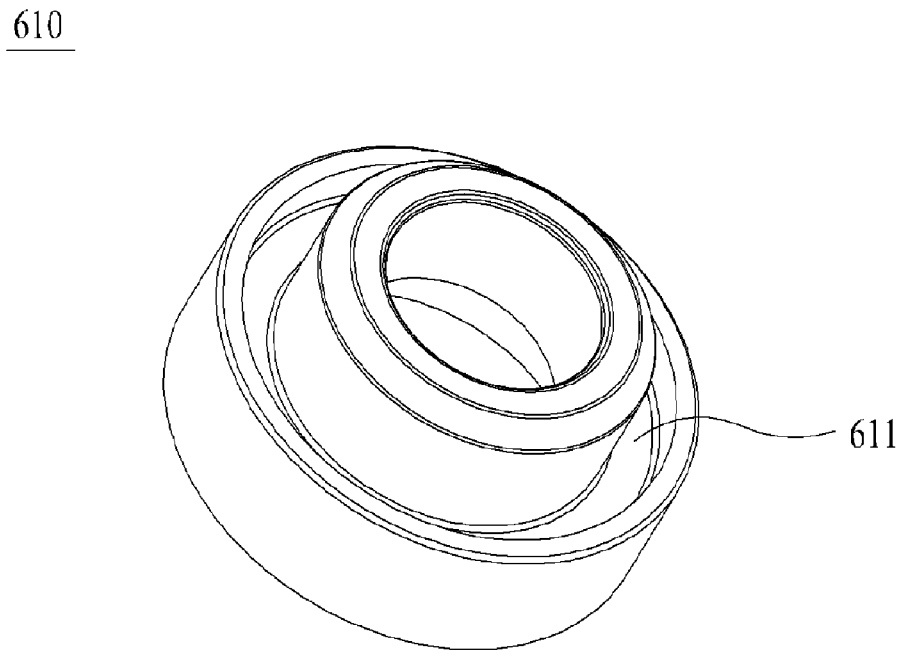

Referring to FIGS. 10A and 10B, the sealing holder 610 has a ring shape coupled to the second rotation shaft 316, tightly. The sealing holder 610 has an inserting hole 612 recessed inward toward the second rotation shaft 316.

Figure 11:
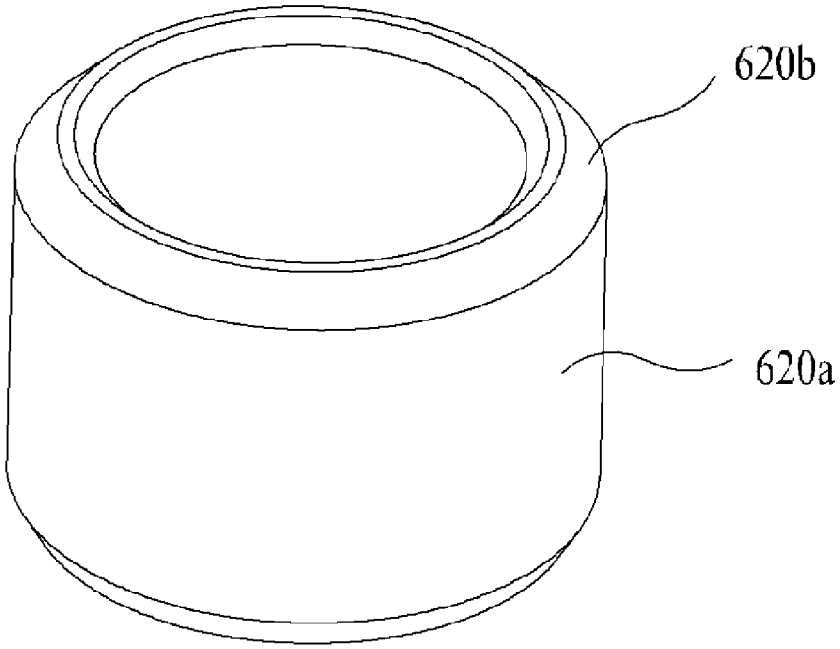
FIG. 11 illustrates a perspective view of a compression ring in an EGR valve for a vehicle in accordance with a preferred embodiment of the present invention.

Referring to FIG. 11, the sealing member 600 also has a compression ring 620 positioned between the exhaust control valve 320 coupled to the second rotation shaft 316 and the sealing holder and inserted in the inserting hole 612 in the sealing holder 610.

The compression ring 620 is in linear contact to an inside of the sealing holder 610, and between the coupling 314 and the sealing holder 610, there is an elastic member 630 for biasing the sealing holder 610 toward the compression ring 620. Though the elastic member is shown as a spring on the drawing, the elastic member may have other forms.

Figure 12:
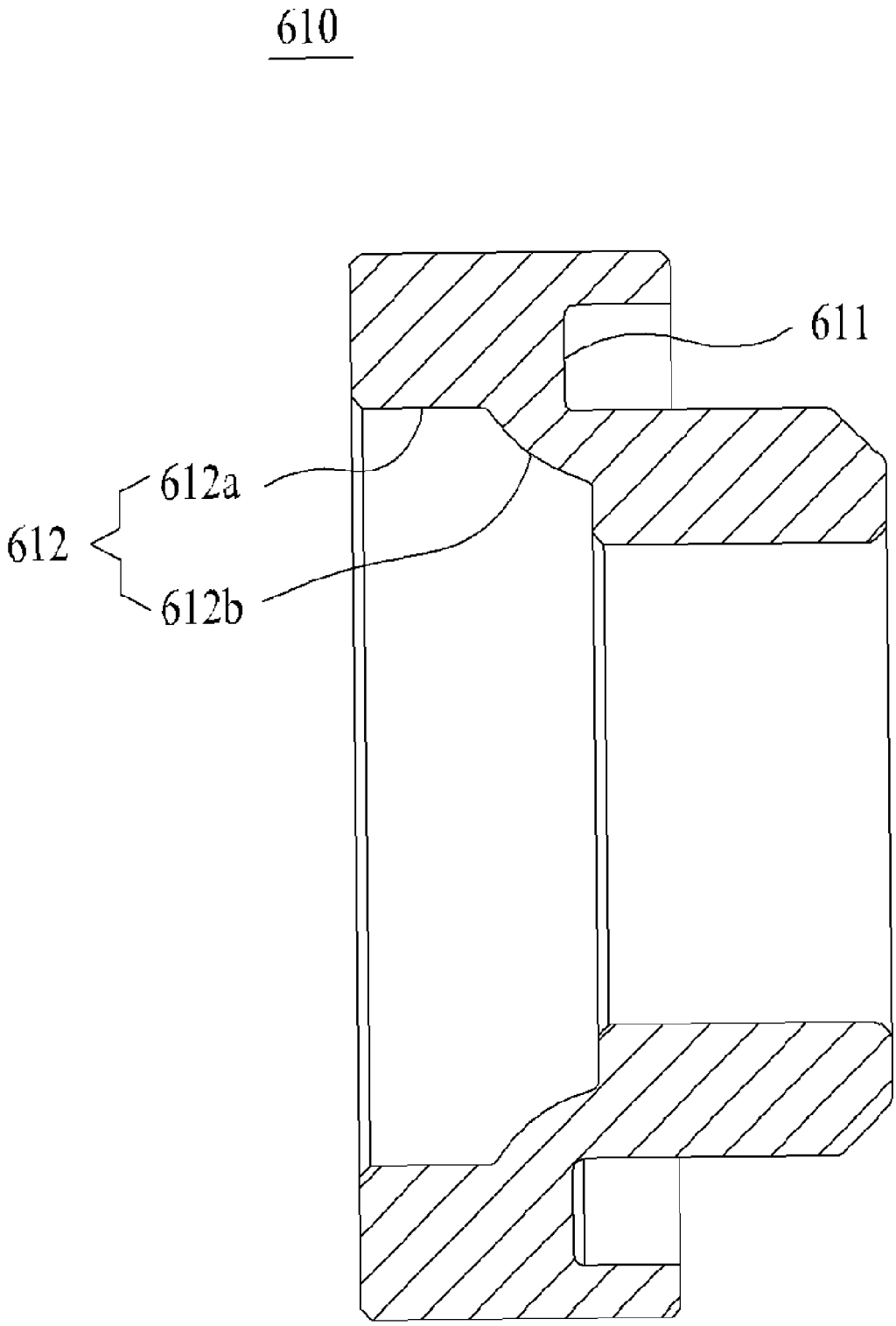
FIG. 12 illustrates a section of a sealing holder in an EGR valve for a vehicle in accordance with a preferred embodiment of the present invention.
Figure 13A:
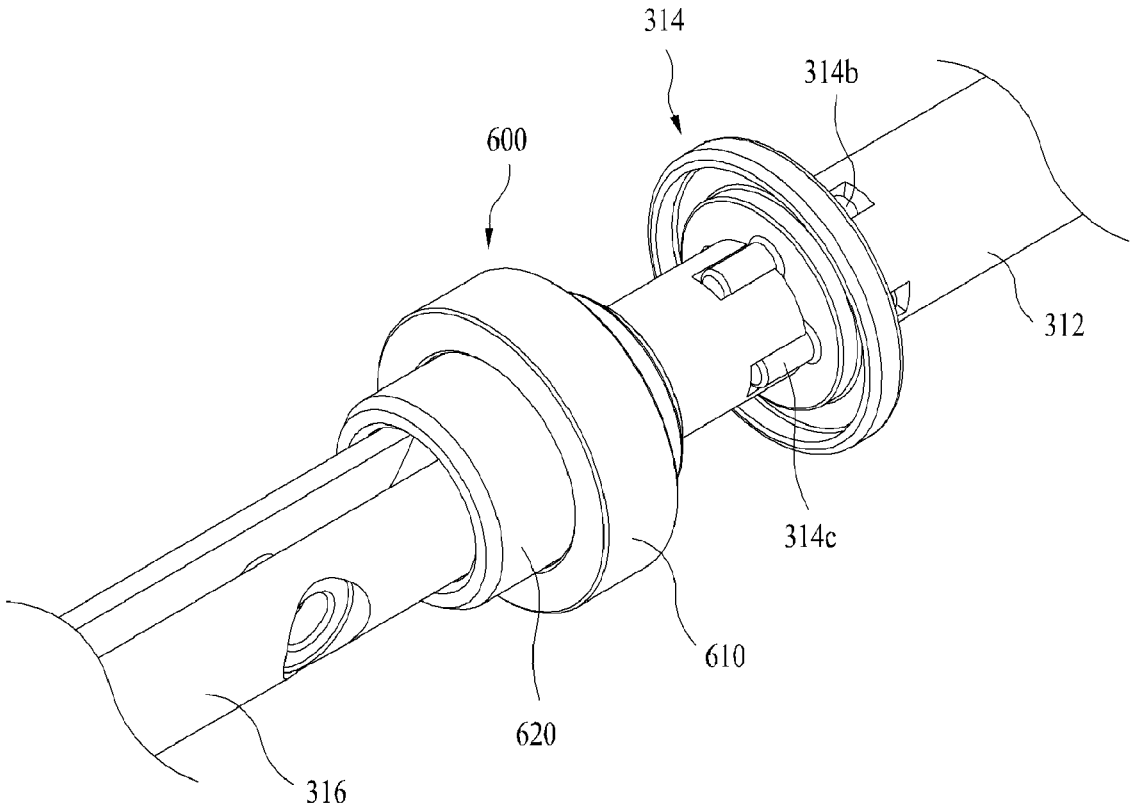
FIGS. 13A and 13B illustrate perspective views of states in each of which a sealing member is coupled, and mounted to a rotation shaft in an EGR valve for a vehicle in accordance with a preferred embodiment of the present invention, respectively.
Figure 13B:
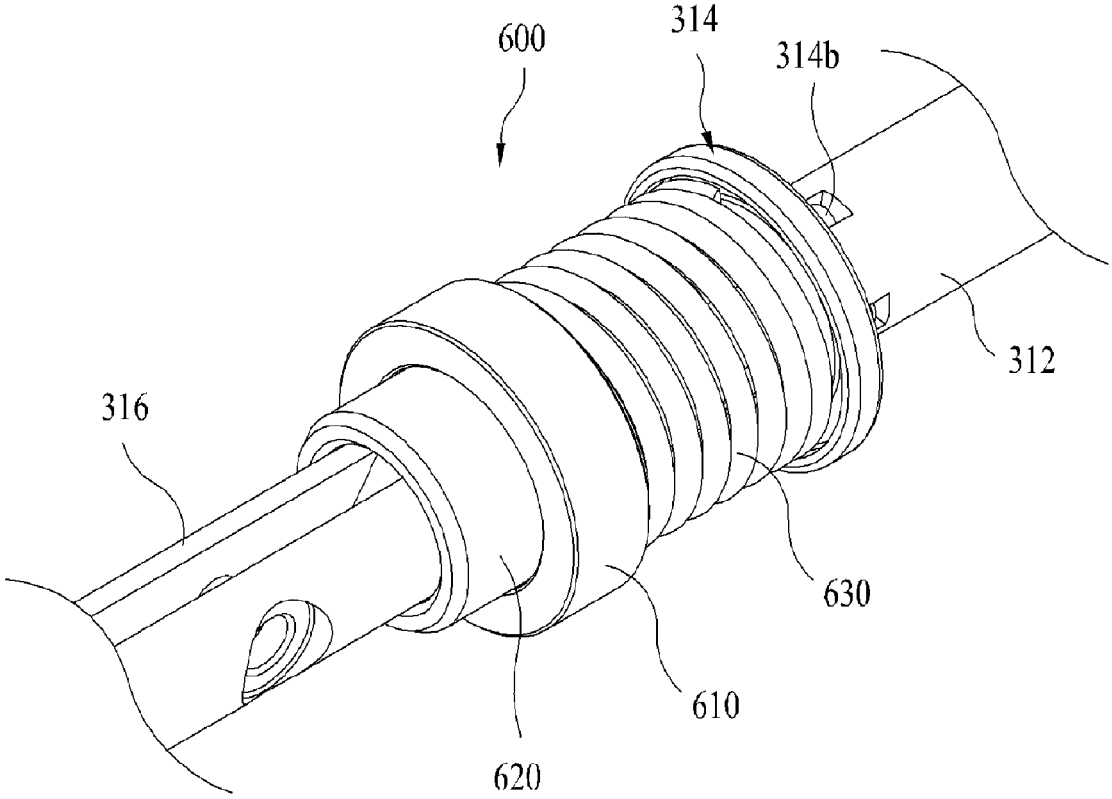

Referring to FIG. 12, the inserting hole 612 has a cylindrical portion 612*a* for making surface to surface contact with an outside circumferential surface of the compression ring 620, and a first sloped portion 612*b* extended from the cylindrical portion 612*a* and sloped inwardly in a length direction of the sealing holder 610.

The compression ring 620 to be joined with the inserting hole 612 has a cylindrical portion 620*a* extended in a length direction of an outside of the compression ring 620 in conformity with the cylindrical portion 610*a* and the first sloped portion 610*b*, and a second sloped portion 620*b* extended from the cylindrical portion 620*a* and sloped inwardly in the length direction of the compression ring 620 for making linear contact to the first sloped portion 610*b*.

The first sloped portion 612*b* is rounded outwardly so as to be projected for making secure linear contact with the compression ring 620.

Though slopes of the first and second sloped portions 610*b* and 620*b* are not specified, it is preferable that the slopes of the first and second sloped portions 610*b* and 620*b* are sloped different from each other for making secure linear contact with the compression ring 620.

Figure 14:
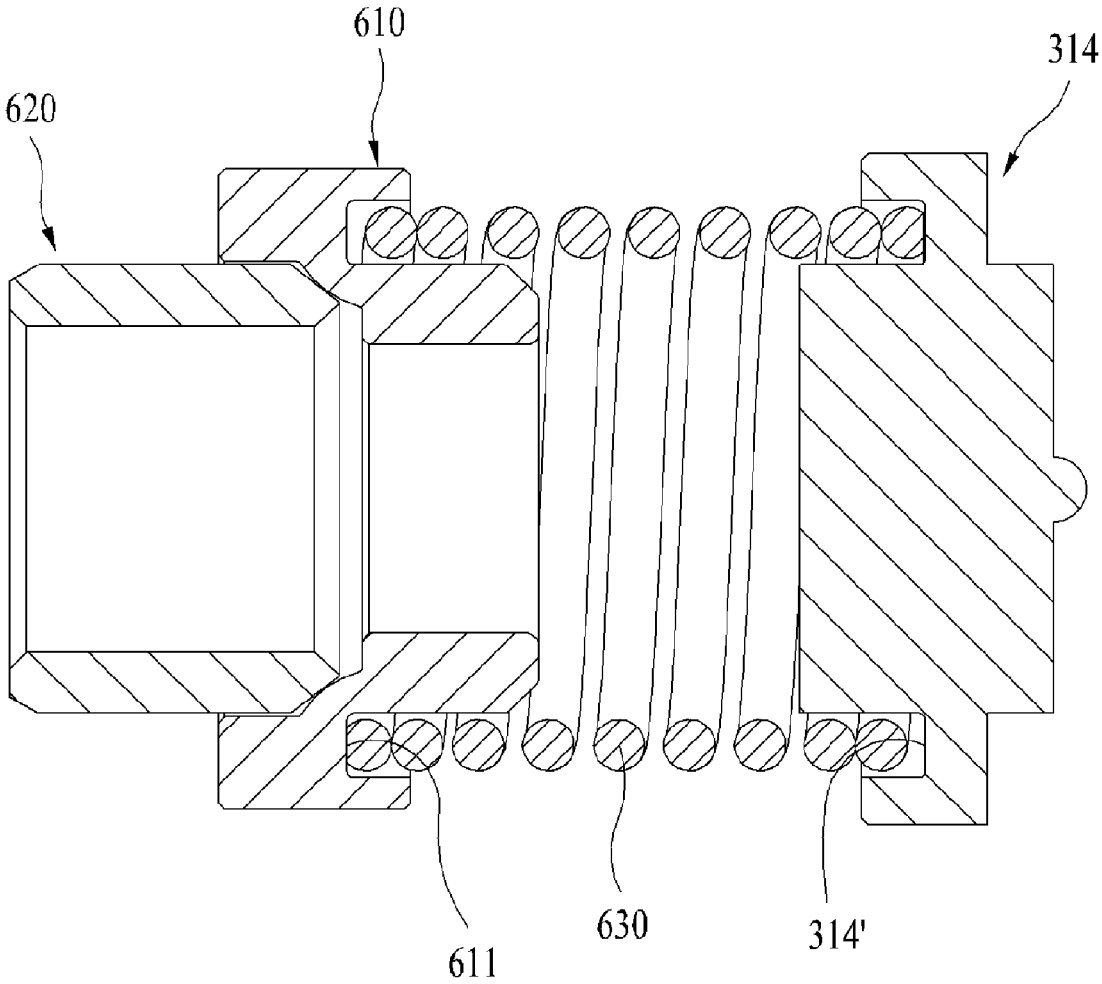
FIG. 14 illustrates a section showing a coupled state of a sealing member in an EGR valve for a vehicle in accordance with a preferred embodiment of the present invention.

Referring to FIG. 14, the coupling 314 and the sealing holder 610 have seating recesses 314' and 611 for inserting and seating opposite ends of the elastic member 630 respectively. The seating recesses 314' and 611 are recesses for mounting the elastic member 630, securely. The sealing holder 610 is press fit on the second rotation shaft 316, and biased toward the second rotation shaft 316 by the elastic member 630.

The operation of the EGR valve for a vehicle of the present invention will be described with reference to the drawings.

Figure 15A:
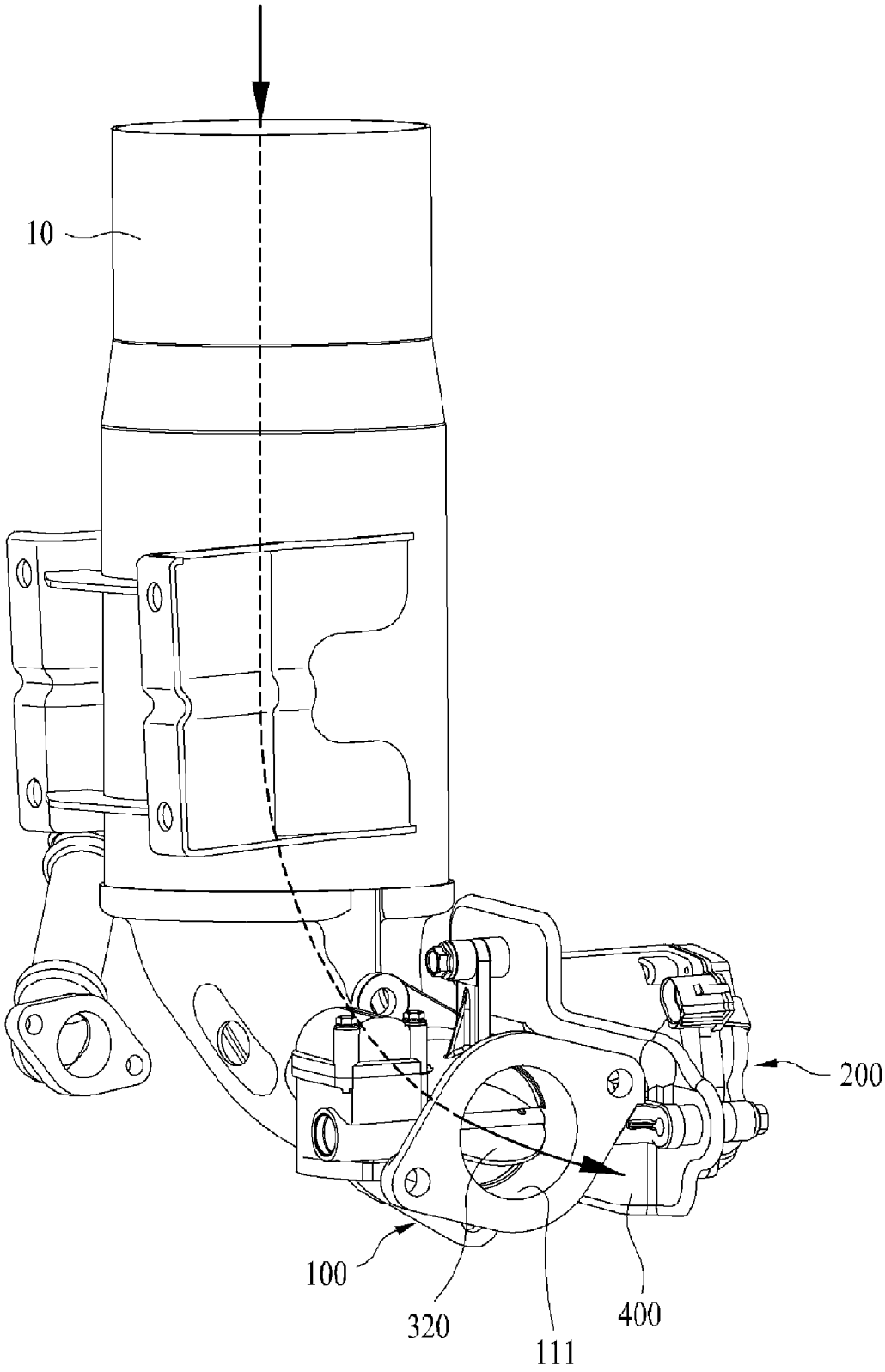
FIGS. 15A~15E illustrate operation states of an EGR valve for a vehicle.
Figure 15B:
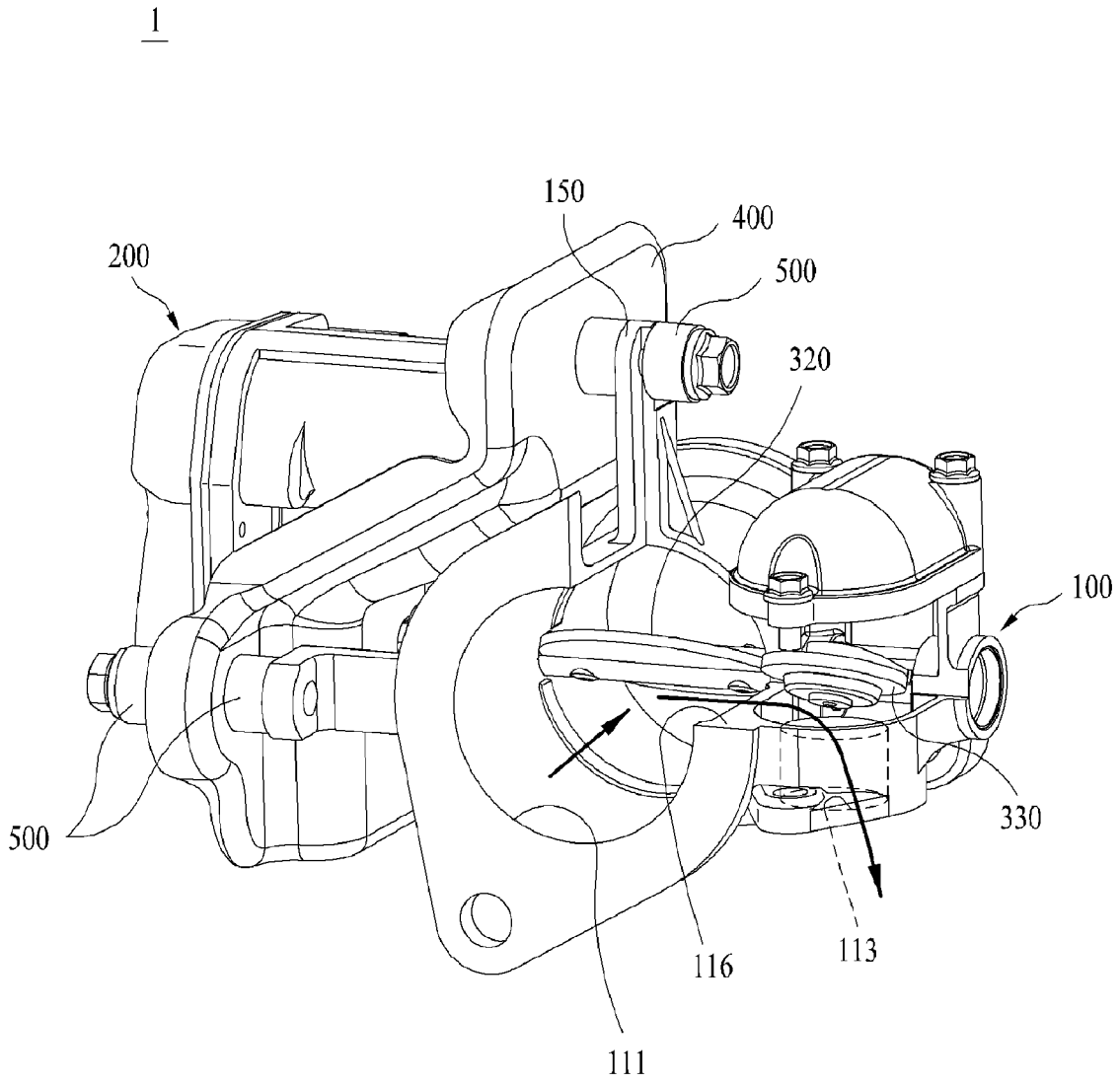

Referring to FIG. 15A, the EGR valve 1 is mounted in the exhaust line 10 through which the exhaust gas is discharged from the engine (not shown).

If a driver turns on a starter in a state the driver is on the vehicle, the engine is operated, and the high temperature exhaust gas flows in a direction of an arrow through the exhaust line 10 from the engine.

Since the motor in the driving unit 200 is not operated before the engine is operated, the rotation shaft 310 of the EGR valve 1 has no driving force applied thereto before the engine is operated.

In this state, the exhaust control valve 320 is in a position in which the exhaust control valve 320 closes the exhaust gas hole 111, and the re-circulation control valve 330 is in a position in which the re-circulation control valve 330 opens the EGR hole 113.

The exhaust gas from the engine generated as the engine is operated moves through the exhaust line 10. The exhaust gas generates harmful substances, including carbon monoxide CO, hydrocarbon HC, nitrogen oxides NOx.

A controller (not shown) of the EGR valve 1 is pre-programmed according to a flow rate of the exhaust gas of the vehicle, and a kind of the vehicle (a gasoline vehicle or a diesel vehicle) for minimizing emission of the nitrogen oxides included in the exhaust gas to the atmosphere, for rotating the shaft of the motor in the driving unit 200 under the control of the controller to rotate the rotation shaft 310.

The operation of the EGR valve of the present invention will be described with reference to the attached drawings.

Referring to FIGS. 3 to 15A, the driving unit transmits the rotation force to the first rotation shaft 312 through the motor shaft, and the first rotation shaft 312 rotates in one direction.

Since the first cross recess 312*a* in the first rotation shaft 312 is engaged with the first cross shaft 314*b*, the first cross recess 312*a* receives the rotation force from the first rotation shaft 312 as it is and transmits to the second rotation shaft 316 engaged with the second cross shaft 314*c* on the other side.

The second rotation shaft 316 receives the driving force from the driving unit 200 as it is to rotate the exhaust control valve 320 in an opening direction from a closed state of the exhaust gas hole 111. Since an angle of opening of the exhaust control valve 320 varies, the angle will not be defined, specifically.

Following opening of the exhaust control valve 320, the re-circulation control valve 330 mounted to the second rotation shaft 316 also rotates toward the EGR hole 113 in proportion to the opening of the exhaust control valve 320.

Referring to FIG. 14A, the exhaust gas flows as shown in the drawing via the exhaust gas hole 11, and as the exhaust control valve 320 is opened at a particular angle, the exhaust gas flows through the EGR hole 113 via the bypass flow line 116 (See FIG. 2) and the recirculation control valve 330.

The exhaust gas flown through the EGR hole 113 flows toward the suction manifold and introduced to the engine again, for reducing a combustion temperature of the engine and improving a fuel cost.

The closing operation of the recirculation valve will be described with reference to the attached drawings.

Referring to FIG. 5, as described before, when the recirculation control valve 330 is closing, the driving unit 200 is put into operation under the control of the controller, to rotate the second rotation shaft 316.

At the time the recirculation control valve 330 is closing the EGR hole 113, the valve seat 334 forms a minute gap around the supporting shaft 332 at the supporting shaft 332 as shown in arrow in the drawing.

In a state the recirculation control valve 330 is biased at one side by the valve seat spring 336, the recirculation control valve 330 has a pressure of the exhaust gas applied thereto in a direction shown in a dashed arrow and spring force applied thereto from the valve seat spring 336 at the same time. As the valve seat 334 is brought into close contact with the EGR hole 113 by the pressure of the exhaust gas and the spring force tightly, the recirculation control valve 330 can maintain a sealing state of the EGR hole 113, securely.

Because the valve seat 334 closes the EGR hole 334 perfectly owing to above operation of the valve seat 334, without forming a gap between the EGR hole 113 and the valve seat 334, leakage of the exhaust gas can be prevented.

The heat cutoff operation of the EGR valve will be described with reference to the attached drawings.

Figure 15C:
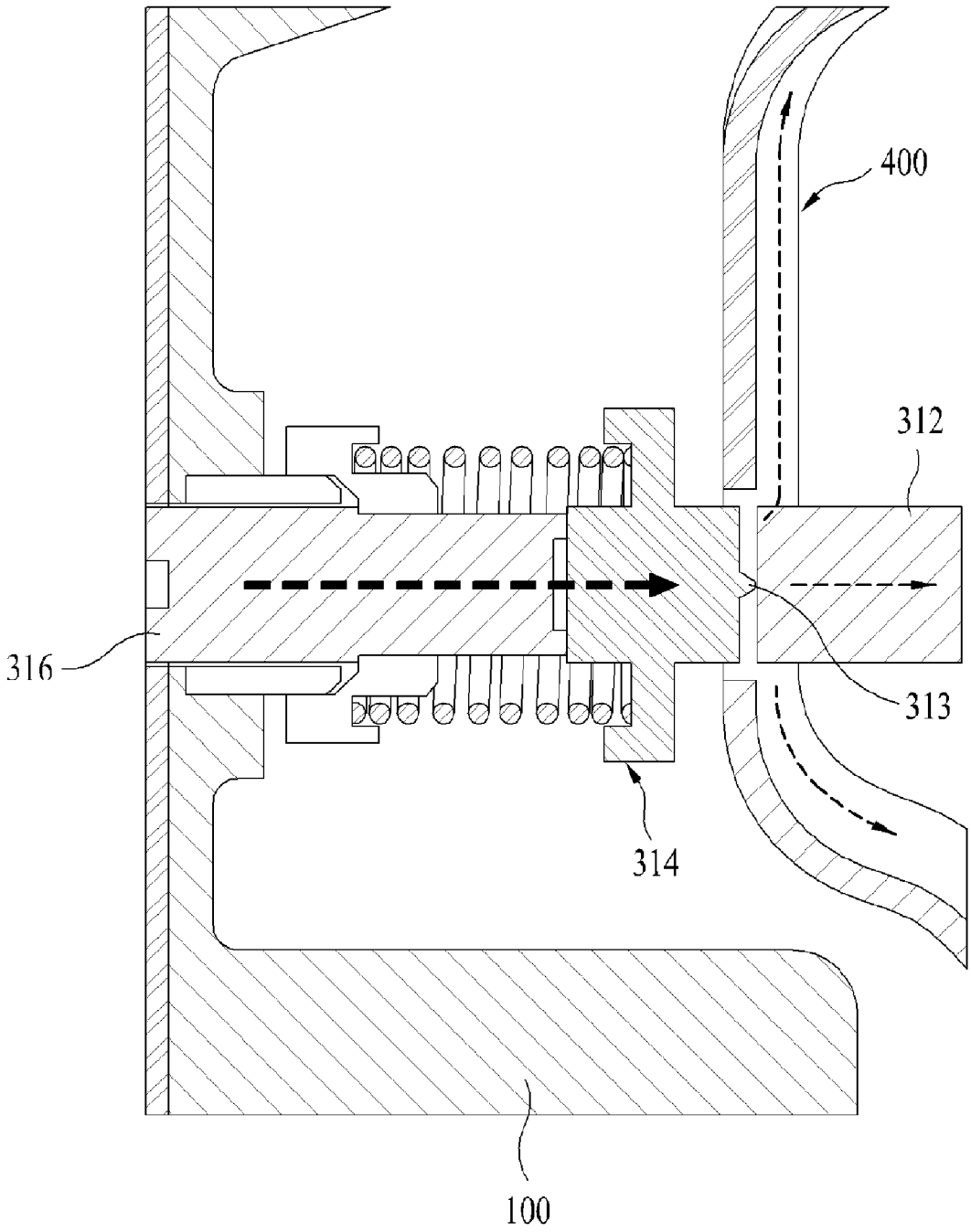

Referring to FIG. 15C, it is inevitable that the valve housing 100 of the EGR valve 1 becomes at a high temperature due to heat conduction from the high temperature exhaust gas flowing through the exhaust gas hole 111.

The exhaust control valve 320 and the recirculation control valve 330 in the valve housing 100 become hot due to heat conduction from repetitive flow of the high temperature exhaust gas, to conduct the heat of the high temperature gas through the rotation shaft 310 having the exhaust control valve 320 and the recirculation control valve 330 mounted thereto.

The second rotation shaft 316 having the exhaust control valve 320 mounted thereto is kept exposed to the high temperature exhaust gas to have the heat conducted thereto. The heat conducted through the second rotation shaft 316 is conducted to the coupling 314 via the second rotation shaft 316 as shown with a thick dashed line.

Since the coupling has the spacing projection 313 at a place connected to the first rotation shaft 312, though a quantity of heat proportional to an area of a diameter of the second rotation shaft 316 is conducted up to the spacing projection where only a quantity of heat proportional to an area of a diameter of the spacing projection is conducted to the first rotation shaft 312.

That is, as the coupling 314 and the first rotation shaft 312 are in point to point contact, the heat conduction from the second rotation shaft 316 to the first rotation shaft 312 is minimized.

If the heat conduction is made thus, the degradation of the driving unit 200 connected to the first rotation shaft 312 can be prevented, permitting to minimize damage to the motor and a printed circuit board mounted in the driving unit 200.

Moreover, together with the spacing projection 313, the heat cutoff plate 400 mounted between the valve housing and the driving unit 200 cuts off the radiant heat from the valve housing 100 to prevent the radiant heat from reaching to the driving unit 200, and the radiant heat is spread along and disperses from the heat cutoff plate 400.

Since the coated layer 302 on the rotation shaft is nitrided, even if the rotation shaft 310 is exposed to the high temperature exhaust gas for a long time period, the coated layer 302 can improve corrosion resistance, abrasion resistance, and fatigue strength.

Along with the heat cutoff by means of the spacing projection 313 and the heat cutoff plate 400, the bushes 500 mounted to the mounting portion 150 where the valve housing and the driving unit 200 fastened thereto cuts off the heat from conducting to the driving unit 200.

Since the bushes 500 of ceramic cut off the heat conduction toward the driving unit to the maximum in a state the bushes 500 are fastened with bolts, degradation of the driving unit 200 can be prevented.

The sealing which prevents the exhaust gas flowing through the EGR valve from leaking will be described with reference to the drawings.

Figure 15D:
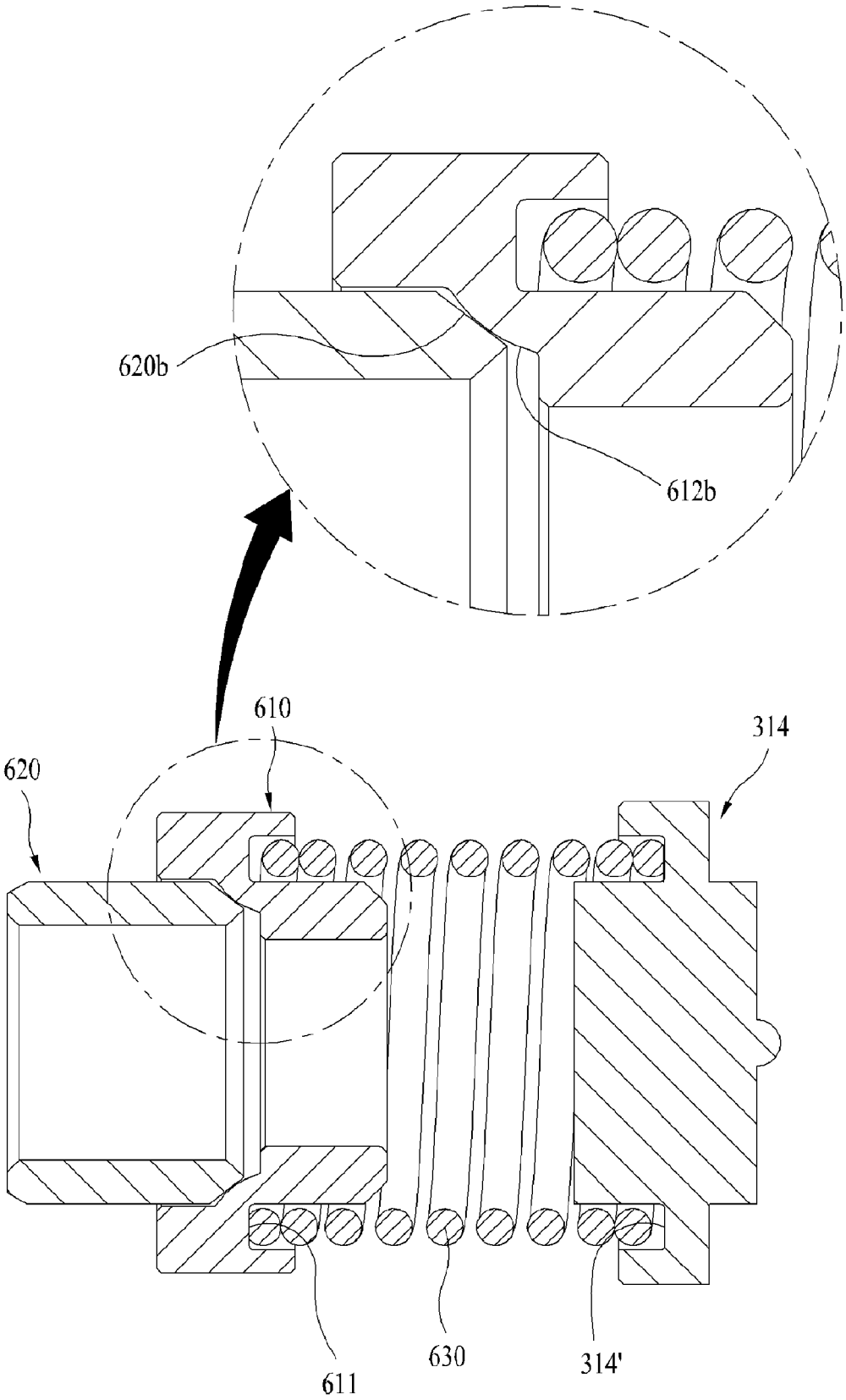
Figure 15E:
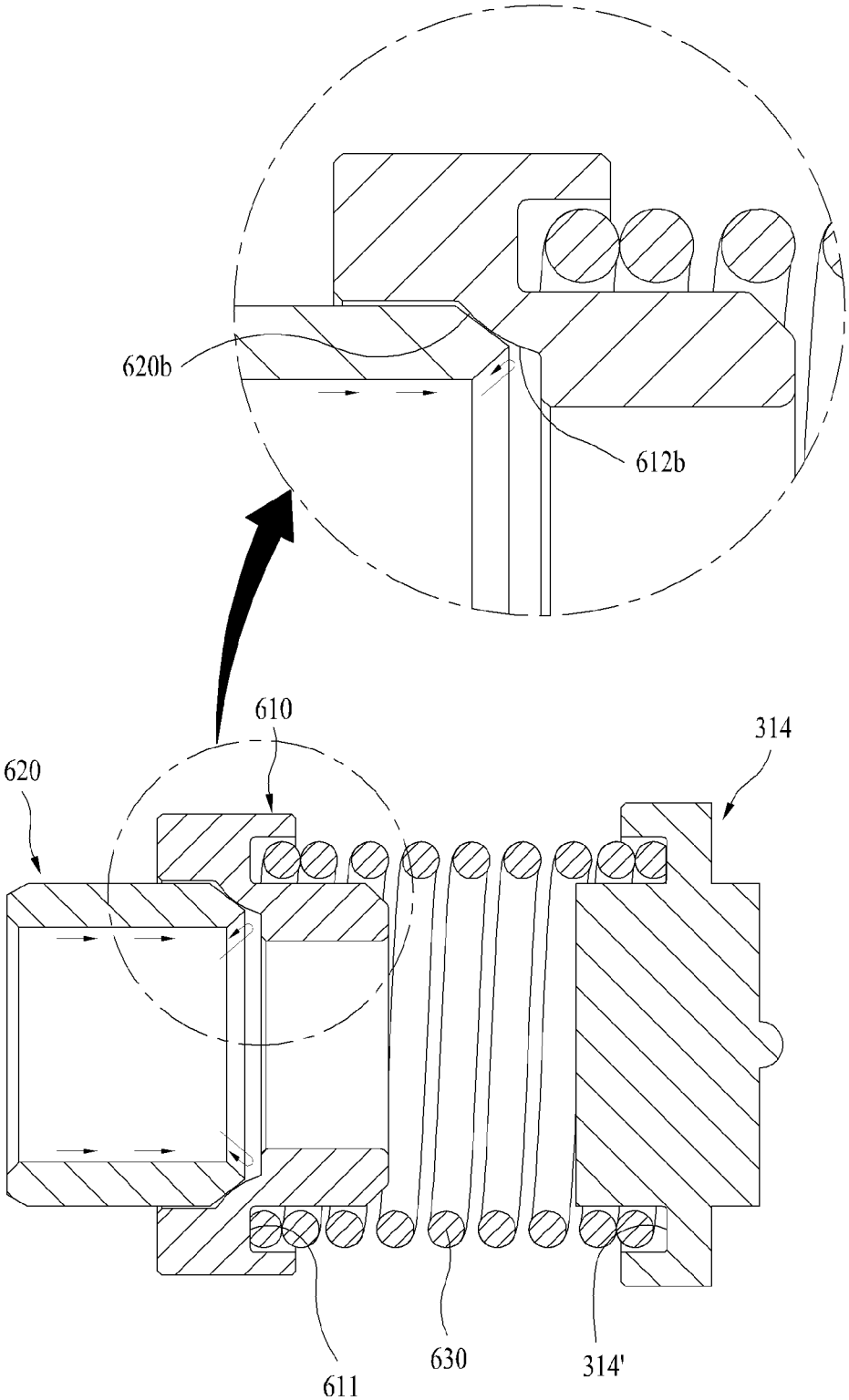

Referring to FIGS. 15C~15E, while the EGR valve 1 is operated as described before, the elastic member 630 presses the sealing holder 610 toward the compression ring 620. FIG. 15C illustrates the second rotation shaft not placed in the compression ring 620, yet.

Referring to FIG. 15E, the rotation shaft 310 (See FIG. 3) connected to the driving unit 200 is rotated repeatedly by the driving unit 200. since the rotation shaft 310 positioned in the valve housing 100 is connected to the driving unit 200 via the valve housing 100, the exhaust gas can move following the second rotation shaft 316 in the rotation shaft 310.

Referring to FIG. 15E, though the compression ring 620 has the second rotation shaft 316 (not shown) engaged to an inside surface, there is a minute gap formed between an outside circumferential surface of the second rotation shaft 316 and the inside circumferential surface of the compression ring 620. The gap means very minute gap enough to permit the exhaust gas infiltrates therein and leaks to an outside thereof even in a case the second rotation shaft 316 is brought into close contact with the inside circumferential surface of the compression ring 620, tightly.

The exhaust gas introduced to the gap moves along the cylindrical portion 620*a* until the first sloped portion 612*b* and the second sloped portion 620*b* make linear contact where the exhaust gas, leaks not to an outside of the sealing holder 610, but re-circulates to a gap between the inside circumferential surface of the compression ring 620 and the outside circumferential surface of the second rotation shaft 312, and therefrom flows into an inside of the valve housing 100.

Owing to this, no exhaust gas leaks to an outside thereof through the gap, and stable operation of the EGR valve can be made, and the leakage of the exhaust gas to an outside of the EGR valve can be prevented regardless of the rotation of the rotation shaft 310 following operation of the driving unit 200 owing to the secure engagement of the linear contact portions between the first sloped portion 612*b* and the second sloped portion 620*b*.

The elastic member 630 enables to the first sloped portion 612*b* and the second sloped portion 620*b* to make linear contact by keeping applying a pressure to the seating recess 611, to improve sealing and preventing leakage of the exhaust gas to an outside of the EGR valve.

Since the linear contact portions of the first sloped portion 612*b* and the second sloped portion 620*b* maintain a linear contact state while having least linear contact area, friction at the contact surfaces caused by the repetitive rotation of the rotation shaft 310 is minimized, and generation of a load is minimized.

Since the slopes of the first sloped portion 620*b* and the first sloped portion 612*b* are different from each other, the linear contact state can be made securely. Though the slopes of the first sloped portion 620*b* and the first sloped portion 612*b* are not defined specifically, it is preferable that the slopes are different from each other for maintaining the linear contact state.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As has been described, the EGR valve of the present invention has the following advantages.

The EGR valve in a vehicle can reduce a combustion temperature and fuel cost since the driving of the EGR valve by means of one driving source enables effective operation of the EGR valve.

The prevention of degradation of the driving unit caused by the radiant heat and conductive heat generated at the EGR valve permits a lifetime of the EGR valve.

The reduction of leakage of the exhaust gas from the EGR valve to the atmosphere permits to minimize emission of pollutants, and the linear contact permits to reduce an operation load and minimize noise.

The EGR valve of the present invention can improve marketability of the EGR valve.

What is claimed is:

1. An EGR valve for a vehicle comprising:

a valve housing connected to an exhaust line for discharging exhaust gas therethrough, having a flow line with an inside area divided for taking and re-circulating a portion of the exhaust gas to a suction manifold;

a driving unit on one side of the valve housing, and a valve unit mounted in a flow line of the valve housing for receiving driving force from the driving unit directly to control flows of the exhaust gas flowing through the flow line at the same time, individually, wherein the valve unit includes:

a plurality of valves configured to close or open a plurality of holes formed in the valve housing; and rotation shaft coupled to the driving unit and the plurality of valves, the rotation shaft including:

a first rotation shaft coupled to the driving unit;

a second rotation shaft coupled to the plurality of valves; and a coupling coupled to the first rotation shaft and the second rotation shaft for receiving rotation force through the first rotation shaft and for transmitting the rotation force to the second shaft, and for preventing heat from transmitting to the first rotation shaft from the second shaft.

2. The EGR valve as claimed in claim 1, wherein the flow line in the valve housing includes;

an exhaust gas flow line having an exhaust gas hole formed therein for flow in/out of the exhaust gas; and a recirculation flow line having an EGR hole for recirculation of the exhaust gas to the suction manifold.

3. The EGR valve as claimed in claim 2, wherein the flow line in the valve housing further includes a bypass flow line for making the exhaust gas flow line and the re-circulation flow line in communication.

4. The EGR valve as claimed in claim 2, wherein the rotation shaft is coupled to the driving unit and is passed through the flow line in the valve housing, wherein the plurality of valves includes:

an exhaust control valve mounted to the rotation shaft for controlling opening of an exhaust gas hole according to rotation of the rotation shaft, and a re-circulation control valve mounted to the rotation shaft for controlling opening of an EGR hole according to rotation of the rotation shaft.

5. The EGR valve as claimed in claim 4, wherein the re-circulation control valve includes;

a supporting shaft connected to and extended outward from the rotation shaft, a valve seat placed on the supporting shaft for opening/closing the EGR hole according to rotation of the rotation shaft, a seat spring placed on the supporting shaft for applying elastic force to the valve seat in a length direction of the supporting shaft, and a seat spring holder on an inside of the seat spring for holding the seat spring in a state the seat spring is placed in the seating spring holder to prevent the seating spring from falling off the supporting shaft.

6. The EGR valve as claimed in claim 4, wherein the opening of the exhaust control valve is linearly proportional to the opening of the recirculation control valve.

7. The EGR valve as claimed in claim 1, further comprising a heat cutoff plate mounted between the valve housing and the driving unit for preventing the driving unit suffering from damage by the high temperature exhaust gas flowing through the flow line.

8. The EGR valve as claimed in claim 4, wherein:

the first rotation shaft is coupled to a gear unit in the driving unit, and the second rotation shaft is coupled to the other side of the coupling having the exhaust control valve and the re-circulation valve mounted thereto.

9. The EGR valve as claimed in claim 1, wherein the coupling includes;

a coupling plate, first and second cross shafts projected outwardly to left and right directions from the coupling plate respectively, wherein the first and second cross shafts are engaged with first and second cross recesses in ends of the first and second rotation shafts respectively.

10. The EGR valve as claimed in claim 9, wherein the first cross shaft includes a spacing projection on a center for preventing heat from transmitting to the first rotation shaft from the high temperature exhaust gas through the second rotation shaft and the coupling, wherein the spacing projection makes point to point contact with the center of the inside of the first cross recess in the first rotation shaft.

11. The EGR valve as claimed in claim 1, wherein the valve portion has a sealing member mounted thereto for preventing leakage of the exhaust gas.

12. The EGR valve as claimed in claim 8, wherein the sealing member includes a sealing holder coupled to the second rotation shaft on an outside circumference of the second rotation shaft in a direction of the second cross recess, wherein the sealing holder has an inserting hole recessed inward toward the second rotation shaft.

13. The EGR valve as claimed in claim 12, wherein the sealing member further includes a compression ring positioned between the exhaust control valve coupled to the second rotation shaft and the sealing holder and inserted in the inserting hole in the sealing holder.

14. The EGR valve as claimed in claim 13, wherein the compression ring is in linear contact to an inside of the sealing holder.

15. The EGR valve as claimed in claim 14, further comprising an elastic member between the coupling and the sealing holder for biasing the sealing holder toward the compression ring.

16. The EGR valve as claimed in claim 11, wherein the sealing member includes a sealing holder coupled to the second rotation shaft on an outside circumference of the second rotation shaft in a direction of the second cross recess, wherein the sealing holder has an inserting hole recessed inward toward the second rotation shaft.

* * * * *